US006378335B1

(12) United States Patent
Siebenberg

(10) Patent No.: US 6,378,335 B1
(45) Date of Patent: Apr. 30, 2002

(54) COMMON FACETING FOR INDIVIDUAL STONES OF A COMPOSITE OF DIAMONDS

(75) Inventor: Benjamin N. Siebenberg, White Plains, NY (US)

(73) Assignee: Am-Gold Products, Inc., New York, NY (US)

( * ) Notice: Subject to any disclaimer, the term of this patent is extended or adjusted under 35 U.S.C. 154(b) by 0 days.

(21) Appl. No.: 09/794,792

(22) Filed: Feb. 27, 2001

(51) Int. Cl.[7] ..... A44C 17/00
(52) U.S. Cl. ..... 63/32; D11/89; D11/90
(58) Field of Search ..... 63/32; D11/89, D11/90

(56) References Cited

U.S. PATENT DOCUMENTS

D372,883 S * 8/1996 Adler ..... D11/89
D373,971 S * 9/1996 Katz ..... D11/90
D379,776 S * 6/1997 Spitzer ..... D11/90
D384,593 S * 10/1997 Katz ..... D11/90
D389,087 S * 1/1998 Kattan ..... D11/90
D392,588 S * 3/1998 Bachar ..... D11/90
D392,589 S * 3/1998 Bachar ..... D11/90
D392,590 S * 3/1998 Bachar ..... D11/90
D393,230 S * 4/1998 Katz ..... D11/90
D399,165 S * 10/1998 Katz ..... D11/90
D402,913 S * 12/1998 Katz ..... D11/90
D405,024 S * 2/1999 Katz ..... D11/90
D415,062 S * 10/1999 Wolf ..... D11/90
D419,480 S * 1/2000 Wolf ..... D11/90
D430,504 S * 9/2000 Hacmon ..... D11/90
D439,195 S * 3/2001 Wolf ..... D11/90
D440,181 S * 4/2001 Wolf ..... D11/90

* cited by examiner

*Primary Examiner*—B. Dayoan
*Assistant Examiner*—Andrea Chop
(74) *Attorney, Agent, or Firm*—Levisohn, Lerner, Berger & Langsam

(57) ABSTRACT

A composite stone is formed of individual stones in which the faceting of the stones as viewed from the top is substantially identical. Providing a uniform faceting for each of the individual stones and substantially identical faceting for such stones provides an overall enhanced brilliance for the composite stone.

4 Claims, 3 Drawing Sheets

COMMON FACETING FOR INDIVIDUAL STONES OF A COMPOSITE OF DIAMONDS

BACKGROUND OF THE INVENTION

This invention relates to a new and novel composite precious stone, especially one arranged to form a heart having enhanced brilliance.

Composite stones are becoming increasingly commercially significant as manufacturers use small stones to form a larger stone so that the users' impression is of a large stone having enhanced values compared to the actual value of the individual elements which make-up the composite stone.

Composite stones take different forms and shapes, and the result in brilliance relates to the chose of stones employed.

Applicant is unaware of any composite stone in which the facet cuts of the adjoining stones are substantially the same. Applicant has found that by employing substantially similar facet cuts for adjoining stones, the overall brilliance of the resulting composite stone is enhanced.

An object of this invention is to provide an improved composite stone having enhanced brilliance.

Another object of this invention is to provide such a composite stone in which interesting and attractive composite stone forms may be provided.

Yet another object of this invention is to provide a composite stone which is susceptible of widespread use, commercial significance and will be economically valuable to the user by providing a composite stone of significantly enhanced brilliance as compared to the cost of the individual stones.

Other objects, advantages and features of this invention will become more apparent from the following description:

SUMMARY OF THE INVENTION

In accordance with the principles of this invention, the above objects are accomplished by providing a composite stone in which the faceting of the adjoining stones are substantially similar or identical. In view of the fact that the adjoining stones may be of different shape, maintaining the faceting of each of the composite adjoining stones as close as possible is the ultimate objective and that what is being sought to be protected by this patent application.

DETAILED DESCRIPTION

Figure 1:
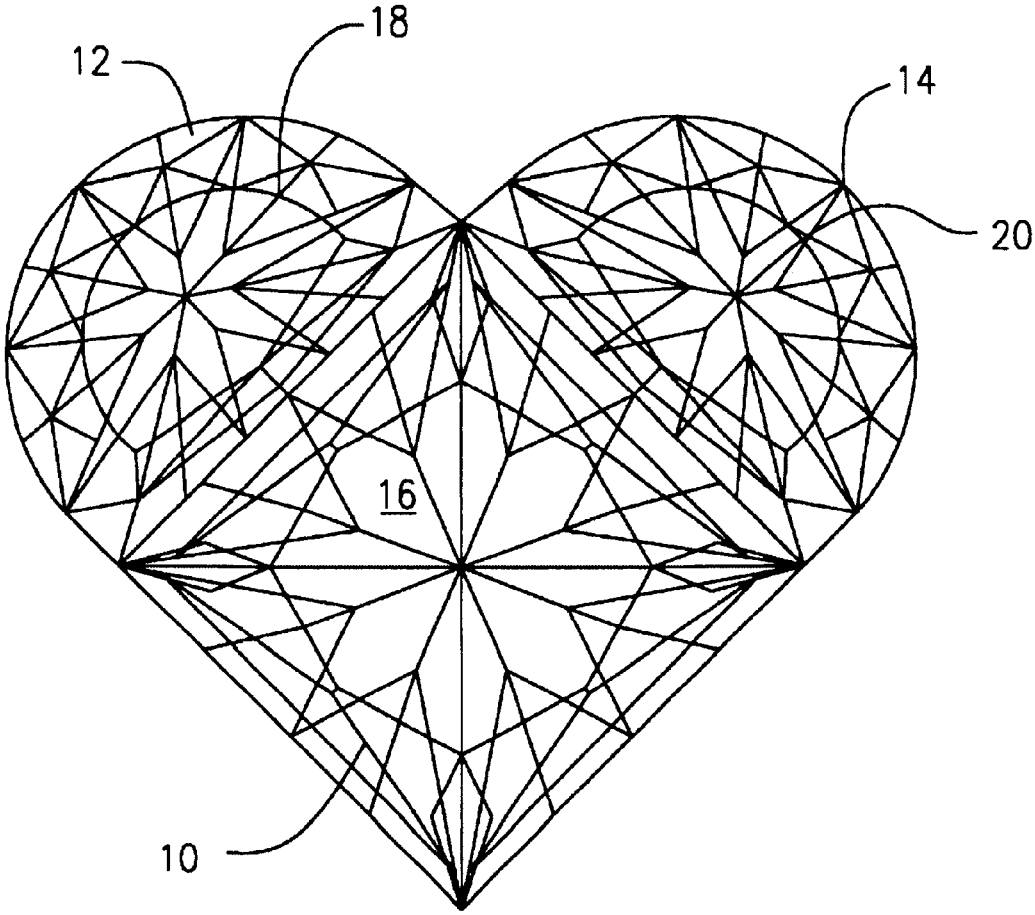
FIG. 1 is a top view of a composite stone of this invention showing a center square or radiant cut in conjunction with two hemispherical stones adjoining the square cut stone.

FIG. 1 is a top perspective view of a preferred embodiment of this invention in which the center stone 10 is substantially square or is a radiant cut formed of faceting indicated by a center apex point 16. Semicircular stones 12 and 14 are placed adjacent respective edges of stone 10 so that an approximate heart shape resulting composite stone is formed as in FIG. 1. The faceting of stones 12 and 14 as reflected by apex points 18 and 20 is substantially identical to the faceting of stone 10.

The setting mechanism for the stones 10, 12 and 14 is not specifically illustrated but could be prong set, invisible set or any other means by which the stones are held together.

Preferably, the stones employed are precious stones such as diamonds which would especially benefit by the composite radiance and brilliance of the total composite stone.

Figure 2:
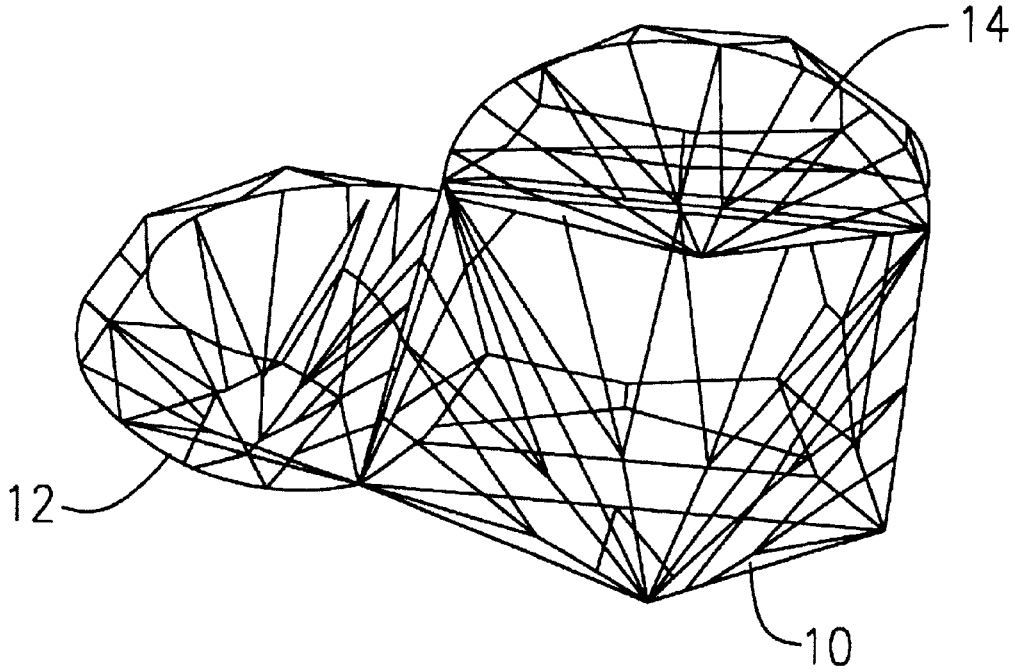
FIG. 2 is a bottom perspective view of the embodiment of the invention shown in FIG. 1.
Figure 3:
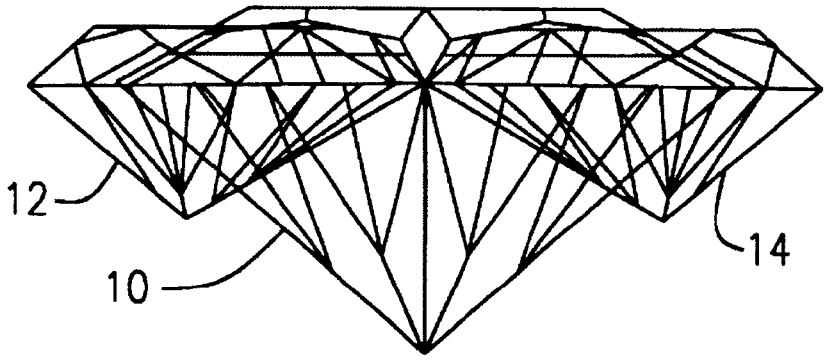
FIG. 3 is a rear plan view of the embodiment of this invention shown in FIG. 1.
Figure 4:
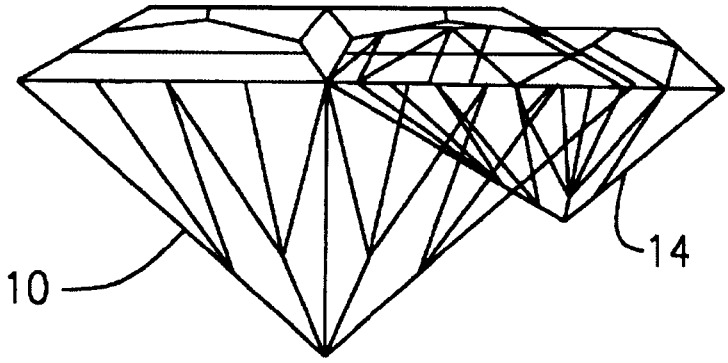
FIG. 4 is a right side view of an embodiment of the invention shown in FIG. 1.

FIGS. 2 through 4 are different views of the preferred embodiment of this invention.

While this invention has been disclosed with reference to a particular embodiment, other composite stones may be formed employing the principles of this invention, which principles are that adjoining stones of a composite stone arrangement have substantially identical faceting from the top view thereof so as provide an overall enhanced brilliant look for the composite stone.

While the invention has been described with respect a particular embodiment, it will be appreciated that the described invention may have other embodiment. Many other variations and applications of the invention will be apparent. The above specification and the detailed description of the preferred embodiment are to be considered as representative only, as the scope of the invention is intended to be covered by the scope of the claims, as interpreted by the Courts, and their reasonable and legal equivalents, as also interpreted by the Courts and applicable statutes.

What is claimed is:

1. A composite stone comprising at least two precious stones, each of said precious stones having at least a single straight edge, said at least two precious stones held adjacent to each other along a respective single straight edge of each of said precious stones, each of said precious stones having respective facet cuts as viewed from the top thereof, wherein the facet cuts of each of said at least two precious stones are substantially identical to each other and wherein one of said at least two precious stones is square, and at least one of the said two precious stones is semi-circular as viewed from the top thereof.

2. A composite stone according to claim 1, wherein said precious stones are diamonds.

3. A composite stone according to claim 1, wherein said composite stone is formed of a center square stone having substantially straight edges and at least two semicircular stones as viewed from the top thereof, at least said single straight edge of each of said semicircular stones adjoining straight edges of said center stone whereby a heart shape composite stone is formed.

4. A composite stone according to claim 3, wherein said precious stones are diamonds.

* * * * *